United States Patent [19]

Vickery

[11] Patent Number: 4,519,896

[45] Date of Patent: May 28, 1985

[54] DRY MATERIAL SORTING DEVICE

[76] Inventor: James D. Vickery, 531 Lindsey Rd., Golden, Colo. 80401

[21] Appl. No.: 357,142

[22] Filed: Mar. 11, 1982

[51] Int. Cl.[3] ..... B07B 9/02

[52] U.S. Cl. ..... 209/44.1; 209/33; 209/135; 209/631; 209/634

[58] Field of Search ..... 209/44.1–44.3, 209/629, 631, 634, 638, 639, 644, 680, 683, 689, 209/925, 910, 906, 932.21, 30–33, 315, 289, 292, 209/133–135, 311

[56] References Cited

U.S. PATENT DOCUMENTS

| | | | |
|---|---|---|---|
| 10,272 | 11/1853 | Gritzner | 209/33 |
| 279,164 | 6/1981 | Hitchcock | 209/142 |
| 846,140 | 3/1907 | Rapp | 209/289 |
| 916,625 | 3/1909 | Stein | 209/33 |
| 1,834,981 | 12/1931 | Stebbins | 209/135 |
| 2,210,103 | 8/1940 | Stoner | 209/44.2 |
| 3,044,619 | 7/1962 | Knolle | 209/33 |
| 3,612,271 | 10/1971 | Behling | 209/644 |
| 3,799,339 | 3/1974 | Breitholtz | 209/639 |
| 4,402,643 | 9/1983 | Lytton et al. | 414/160 |

FOREIGN PATENT DOCUMENTS

| | | | |
|---|---|---|---|
| 732033 | 5/1980 | U.S.S.R. | 209/134 |

OTHER PUBLICATIONS

Chapter 9, Taggart, *Handbook of Mineral Dressing,* John Wiley & Sons, New York, (1964).

*Primary Examiner*—David A. Scherbel
*Assistant Examiner*—Donald T. Hajec
*Attorney, Agent, or Firm*—Klaas & Law

[57] ABSTRACT

A dry material sorting device for selectively sorting mixtures of granular material comprising component materials such as sand and gold having different specific gravities. The use of a horizontal wind tunnel to sort the materials is described. Use of a prescreening device to segregate particles into separate batches based on particle size prior to blowing of the material in the wind tunnel is disclosed. An alternate mode comprising screening of particles after blowing in the wind tunnel using a dynamic screen having variable aperture sizes therein is also disclosed.

17 Claims, 8 Drawing Figures

DRY MATERIAL SORTING DEVICE

BACKGROUND OF THE INVENTION

The present invention relates generally to material separation devices and more particularily to a pneumatic device for physically sorting mixtures of granular materials having component materials, such as sand and gold with different specific gravities.

Much of the earth's desert sands contain commercial quantities of gold and other valuable metals. These metal deposits are the result of alluvial erosion which transport the metals into fans, washes and other sedimentary layers far from the original deposit sites. Exploration has revealed desert areas containing one or more ounces of gold per cubic yard of sand (silicon dioxide). However, the extraction of gold from desert sand has been problematic. The only feasible extraction methods to date have required the use of large quantities of water. Sufficient quantities of water for milling processes are unavailable in most desert areas. Transportation of the gold-bearing sand to milling areas is also unfeasible because of the huge volume of sand accompanying a relatively small amount of gold. A dry milling process capable of sorting the gold into a relatively pure state which can be effected at the deposit site is therefore desirable.

Prior to the present invention no profitable process for extracting gold from vast quantities of sand had been devised. Numerous attempts have been made, including high cost electrostatic machines which are efficient but prohibitively expensive to operate. Prior attempts to use pneumatic devices have not been efficient in that only a relatively small amount of the available gold is extracted at considerable energy costs. Such air transport methods used prior to the invention are essentially the counterpart of water classification. However, water classification relies on buoyancy effects for the separation of particles on the basis of density (specific gravity). Since air exerts essentially no buoyant force, the buoyancy sorting effect is not present in pneumatic systems. Thus prior pneumatic devices have been effective only as a sizing process.

The present invention takes advantage of a specific gravity differentiating effect which has been overlooked or not properly exploited in prior art inventions.

A particle of mass, m, free falling through a horizontal air stream of velocity, V, is accelerated vertically by the force of gravity, G. The particle is accelerated horizontally by the flow of air against and around it having a force usually referred to as "drag", D. The drag force is in turn dependent upon the relative velocity of the wind with respect to the particle. As the particle is accelerated in the horizontal direction, the relative velocity of the particle with respect to the wind diminishes until at some point the particle is moving horizontally at the same velocity as the wind. At this point the drag force on the particle is zero.

Assuming that the particle is of a generally spherical shape (which is true of most products of erosion) and assuming that the operation takes place at a relatively low Reynolds Number such as intended in the present invention, the horizontal drag force may be expressed analytically by Stokes Law:

$D=3\pi\mu Vd$ where

D=drag $\mu$=fluid viscosity of air

V=relative horizontal velocity of the particle with respect to the wind d=diameter of the sphere (See G. G. Stokes, Mathematical and Physical Papers, Vol. III p. 55, Cambridge University Press, 1901; Vennard, Fluid Mechanics; 4th Ed. p. 514, John Wiley & Sons Inc., 1966.) The viscosity of air, $\mu$, under operating conditions of the invention remains constant; thus, it may be seen that the drag force D which accelerates a particle horizontally varies linearly with both the diameter of the particle and with the relative air speed of the particle. Thus, the initial drag force experienced by spherical particles introduced into a moving air stream will vary linearly with the diameter of the particle.

From Newton's second law, the vector force component on a particle in a given direction is proportional to the product of the mass of the particle and the acceleration of the particle in the given direction or F=ma.

The horizontal acceleration, a, of a particle of mass, m, is therefor:

$$a=\frac{F}{M}=\frac{D}{M}=\frac{d\,(3\,\pi\mu V)}{M}$$

From the above, it follows that the acceleration of a particle in an horizontal air stream is linearly proportional to the diameter of the particle and inversely proportional to the mass of the particle. Thus, for particles of the same diameter, the particle having the smaller mass (i.e. smaller specific gravity) will have a greater acceleration. For example, a particle of sand, specific gravity of 2.3, will be accelerated more than a particle of gold, specific gravity 19.3, of the same diameter. This effect will be referred to generally as the "specific gravity effect".

The mass of an object is directly proportional to the product of its volume and specific gravity and may be expressed as $m=K_1(\text{Vol.})(\text{Sp. Gr.})$ where $K_1$ is a constant. For a sphere, the volume may be expressed as 1/6 $\pi d^3$. Thus, $$m=\frac{K_1\pi d^3}{6}\,(\text{Sp.G})$$

and substituting this expression of m into the acceleration equation:

$$a=\frac{K_1\pi\,\dfrac{d(3\pi\mu V)}{d^3\,(\text{Sp. G.})}}{6}=K_2\frac{V}{d^2\,(\text{Sp. G.})}$$

where $K_2$ is a constant. Thus, it may be seen that for spherical particles of the same specific gravity, the acceleration of the particle will be inversely proportional to square of its diameter. For example, large spheres of sand will accelerate more slowly than small spheres of sand. This effect will be referred to generally as the "sizing effect".

Finally, it must be noted, as proven by Galileo's famous experiment, that particles dropped from the same height fall at the same rate regardless of size or density differences. (A vertical drag force may be introduced when the falling velocities become great but this force is insignificant when objects are dropped small distances such as contemplated by the present invention).

Thus, all particles dropped vertically in the horizontal airstream from the same point will pass through it for the same amount of time and during that time two different "effects" will influence the distribution of the particles.

The "specific gravity effect" which causes lighter particles to be initially accelerated more than heavier particles of the same size will cause the heavier particles to fall out of the airstream at a point nearer the drop point then the lighter particles. The "sizing effect" which causes small particles to be accelerated faster than large particles of the same material will cause the large particles to fall at a point nearer the drop point than the small particles.

For particles of different specific gravities of approximately the same size, a moving air stream may be used as a sorting device with denser particles such as gold falling in an area near the drop point and lighter particles such as sand falling at a greater distance. However, where gold and sand particles of random sizes are mixed together, the sorting function of the air stream is diminished because smaller gold particles tend to fall downstream and become intermixed with sand particles of a slightly larger diameter. Thus, the interplay between the "sizing effect" and the "specific gravity effect" prevents proper sorting unless other differentiating techniques are employed in conjunction with the use of an horizontal air stream.

SUMMARY OF THE INVENTION

The present invention utilizes a horizontal air flow to sort particles of different materials which are combined in a granular mixture. Different screening techniques are used in the invention in order to offset the "sizing effect" and effectively sort the granular mixture. One technique employed by the invention is prescreening of material that is to be injected into a horizontal wind tunnel. When particles dropped are of substantially the same diameter the sizing effect is diminished and the particles tend to be sorted on the basis of their respective specific gravities. The fluctuation in particle size that may be tolerated before the sizing effect interferes with the sorting function will depend upon the difference between specific gravities of the materials to be sorted. For example, when the difference in specific gravities is great, such as between gold, specific gravity 19.3 and sand, specific gravity 2.35, relatively large differences in particle sizes may be tolerated. For example, it has been found that when separating gold from sand particle diameter differences on the order of 2:1 may be tolerated. Particles may be segregated on the basis of size by screening. The contents of each screen are injected into the wind tunnel in separate batches.

Another method for overcoming the sizing effect is to use a screen having graduated apertures, referred to hereinafter as a "dynamic screen", to separate particles as they fall out of the wind tunnel. To properly use this technique variously sized particles of the heavier element are dropped into the wind tunnel alone. The distances at which the particles land and the diameters of the particles are recorded. A screen mesh or apertured plate is then constructed having apertures at the experimentally determined points of sufficient size to allow the heavy material particles landing at those points to pass through the apertures at relatively small tolerances. It will be found that this produces a plate having large apertures near the material drop point and progressively smaller apertures proceeding in a downstream direction. When lighter material is injected into the wind tunnel it will be seen that the particles landing on the dynamic screen are of relatively larger sizes than the heavier metal particles landing in the same place. As a result when a mixture of the two materials is injected into the wind tunnel the heavier metal particles will pass through the screen and may be collected thereunder while the lighter material particles are retained on the surface of the screen. If the screen is inclined slightly to one side and vibrated the lighter material may be allowed to roll off the side and collected for removal.

As mentioned above, the mathematically predicted results are based on an assumption that the particles are relatively spherical and that the operation takes place at a relatively low Reynolds Number. If excessive air velocities are used or if a particle's shape varies substantially from a spherical shape, other aerodynamic effects are introduced which reduces the effectiveness of the invention. However, it must also be noted that if air velocities are too low, there may not be sufficient drag force to generate a noticeable separation in the larger particles. Thus determination of air velocity by experimental testing is desirable.

It is an object of the present invention to provide a dry material sorting device which may be used to economically separate granular material particles having different specific gravities. It is another object of the invention to provide a device which uses air rather than water as a sorting medium. It is another object of the invention to provide a device which may be used to economically remove gold from desert sand. It is another object of the invention to provide a dry material sorting device which utilizes a wind tunnel in combination with a dynamic screen. It is another object of the invention to provide a dry material sorting device which utilizes a prescreening apparatus in combination with a wind tunnel. It is another object of the invention to provide a dry material sorting device which utilizes a specific gravity differentiating effect of a horizontal airflow.

BRIEF DESCRIPTION OF THE DRAWING

An illustrative and presently preferred embodiment of the invention is shown in the accompanying drawing wherein.

DETAILED DESCRIPTION OF THE INVENTION

Figure 1:
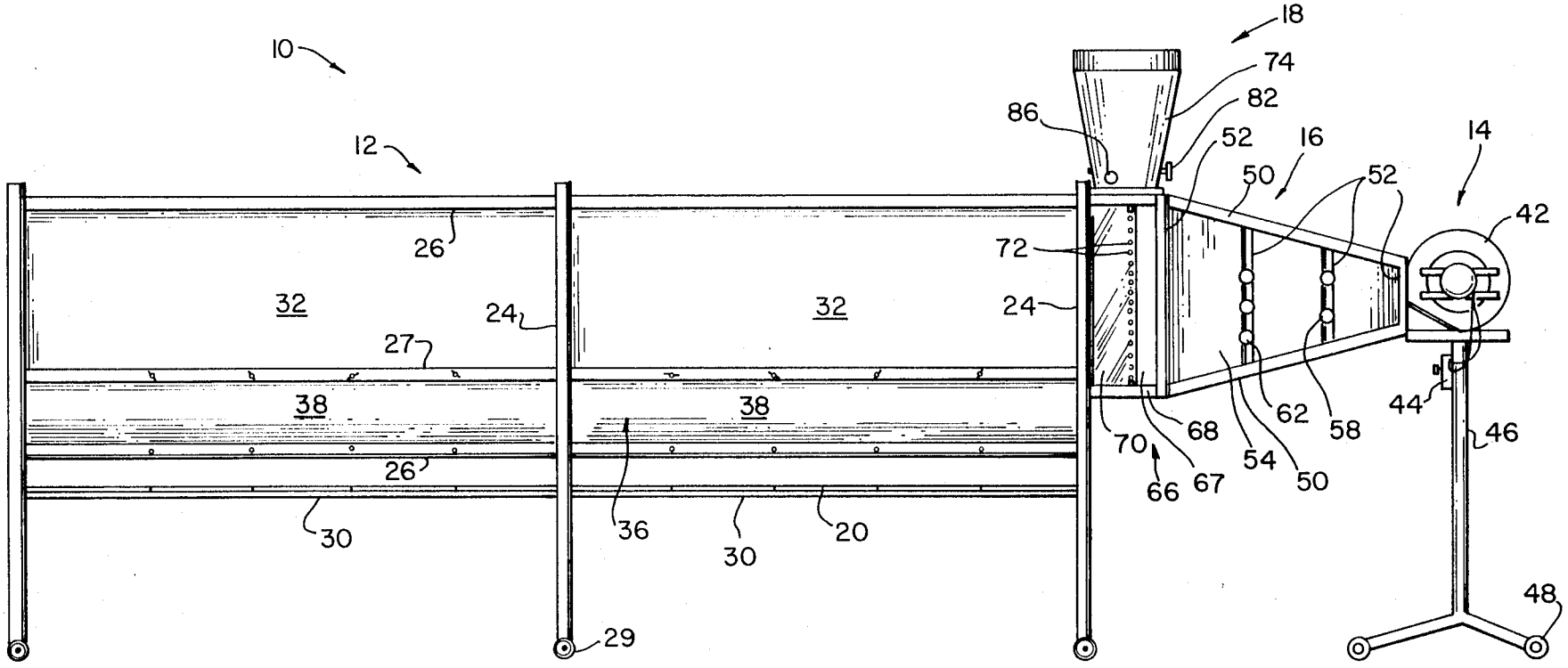
FIG. 1 is an elevation view of a dry material sorting device.
Figure 2:
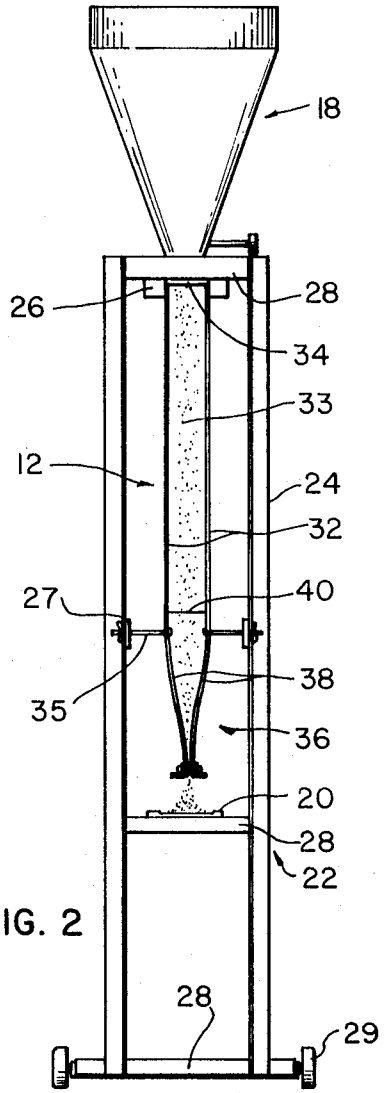
FIG. 2 is a cross sectional elevation view of a dry material sorting device.

As shown by FIG. 1 the dry material sorting device 10 of the present invention comprises a wind tunnel in fluid communication with air forcing means such as a blower 14. A container for holding granular material such as hopper 18 is mounted on an upper portion of the wind tunnel 12 at the upstream end. Particles injected into the wind tunnel airstream fall from the wind tunnel 12 at various points along its length and are directed into a collecting means such as collection tray 20 by an exit means such as skirt 36 mounted at the lower open portion of wind tunnel 12. As shown by FIG. 2 flow chamber as wind tunnel chamber 33 has a generally rectangular cross sectional shape defined by two vertical walls 32 and a top horizontal wall 34 in sealed attachment therewith. The wind tunnel walls 32, 34 are formed from a smooth planar material such as sheet metal or the like. The chamber 33 is open at the bottom end and at either end of the tunnel and the height and cross sectional shape are uniform throughout the length to provide an airflow of relatively constant velocity. Wind tunnel 12 is supported by a frame 22 having spaced vertically upright posts 24 welded or otherwise rigidly attached to longitudinal members 26 and transverse cross members 28. The wind tunnel is supported on the frame 22 as by longitudinal members 26 fixedly attached to either side of wind tunnel walls 32 and/or by connector bolts 35 attached to a lower portion of the walls 32 and connected to connector bar 27. A generally V-shaped skirt 36 comprising skirt walls 38 rigidly attached to the lower portion of wind tunnel walls 32 communicates with the lower portion of the chamber 33 and is used to direct falling particles inwardly at the terminal portion of free fall. Unlike the wind tunnel chamber 33, opposite longitudinal ends of the skirt 36 are enclosed as by skirt plates 40 to prevent horizontal airflow through the skirt.

Figure 3:
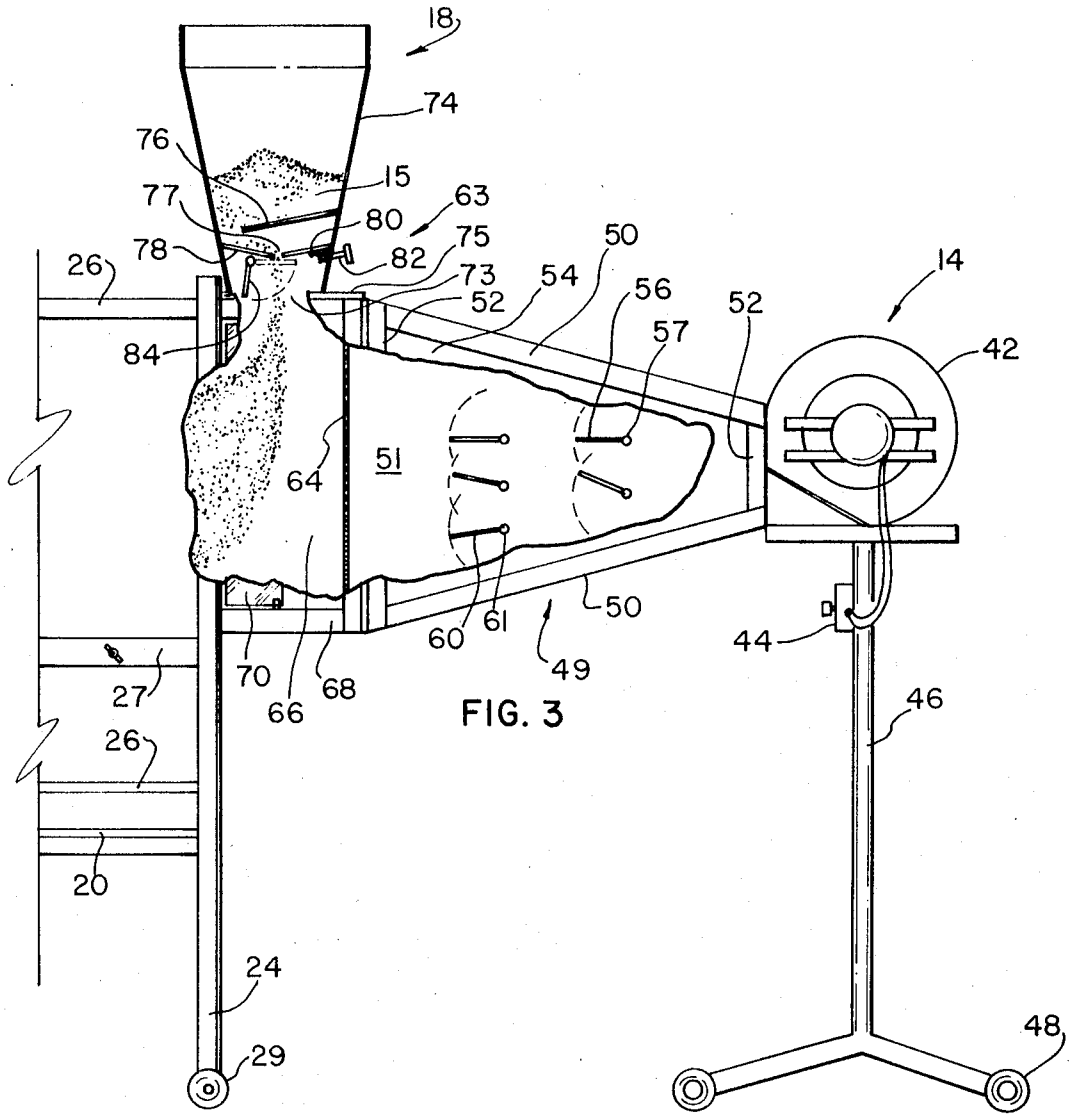
FIG. 3 is a cut away elevation view of a dry material sorting device.

As shown by FIGS. 1 and 3 a blower 42 may be mounted on a suitable stand such as pedestal 46 mounted with wheels 48 to facilitate movement and adjustment during assembly of the device 10. The blower may comprise an induction fan 42 provided with velocity controls 44. The fan 14 discharges into a sealingly connected blower duct 49 of truncated pyramid configuration having a frame formed from inclined longitudinal members 50 and transverse members 52. Side walls 54 of the duct 49 are sealingly attached to the frame members 50, 52 and may be constructed from trapezoidal sheet metal plates or the like. A transverse plate 64 having a plurality of uniformly spaced holes therein may be positioned at the end of the blower duct 16 to equalize pressure distribution within the duct chamber 51. Air veins 56, 60 mounted on air veins shafts 57, 61 may be pivotly mounted on blower duct transverse members 52 and provided with control knobs 62, 58 to adjust and control the direction of air flow through the duct chamber 51. An injection duct 63 comprising injection chamber 66 having an identical cross section to the wind tunnel chamber 33 communicates with connects duct 16 outlet and wind tunnel 12 inlet. The injection chamber 66 is defined by enclosing wall members 67 mounted on longitudinal frame members 68 in turn weldingly or otherwise rigidly attached to wind tunnel and air duct frame members 24,52. A transparent elongate plate 70 may be mounted on a cutout portion of an injection chamber side wall 67 and provided with transverse ports 72. Streamers or the like (not shown) may be inserted through the ports for observing the relative air flow velocities at any point within the injection chamber. The air flow may be adjusted by means of veins 60, 56 to achieve a uniform flow distribution through the injection chamber 66 and wind tunnel chamber 33. Venturi tubes or other devices (not shown) may be inserted in ports 72 to measure air flow velocities. Screw-plugs or other conventional sealing means are provided to close the ports 72 after the measurements have been made. As shown by FIGS. 2 and 3 a hopper 18 having a conically shaped container 74 may be mounted on a mounting plate 75 with a hole 73 therein immediately above the injection chamber 66. The hopper 18 may be provided with baffle plates 76 or a vibrator (not shown) to facilitate movement of granular material 15 therethrough. A transverse slit 77 running the width of the injection chamber 66 may be formed from a fixed plate 68 and movable plate 80 operably mounted on the container wall 74. A slit control knob 82 may be provided to allow an operator to change the width of the slit 77. This control 82 facilitates injection of the proper amount of granular material 15 into the air chamber. If the slit is too large the material will tend to "bunch up" or "piggyback" which diminishes the effectiveness of the device 10 in that all of the particles 15 are not equally exposed to the horizontal air flow. A slit closure plate 84 with control knob 86 may be pivotally mounted below the slit to stop or start the flow of material.

Figure 4:
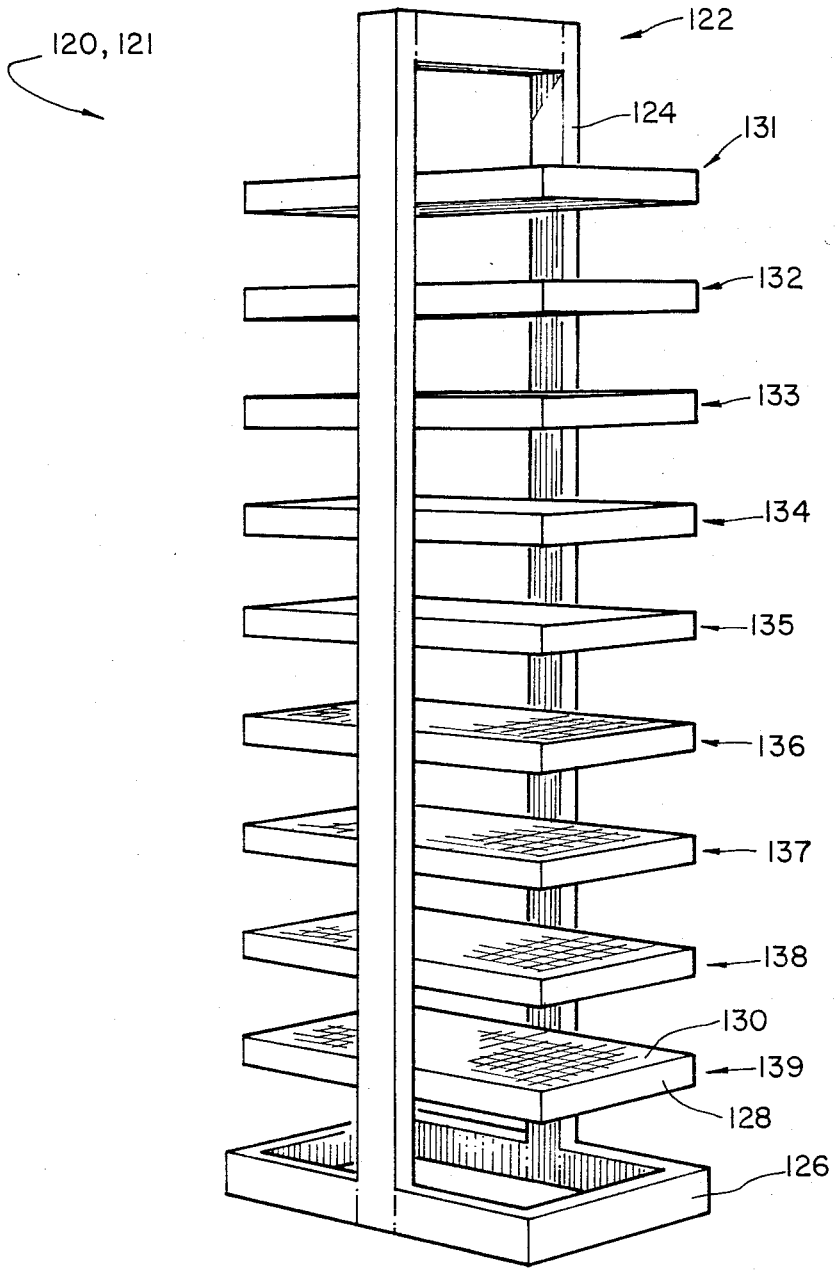
FIG. 4 is a perspective view of a screen apparatus.
Figure 5:
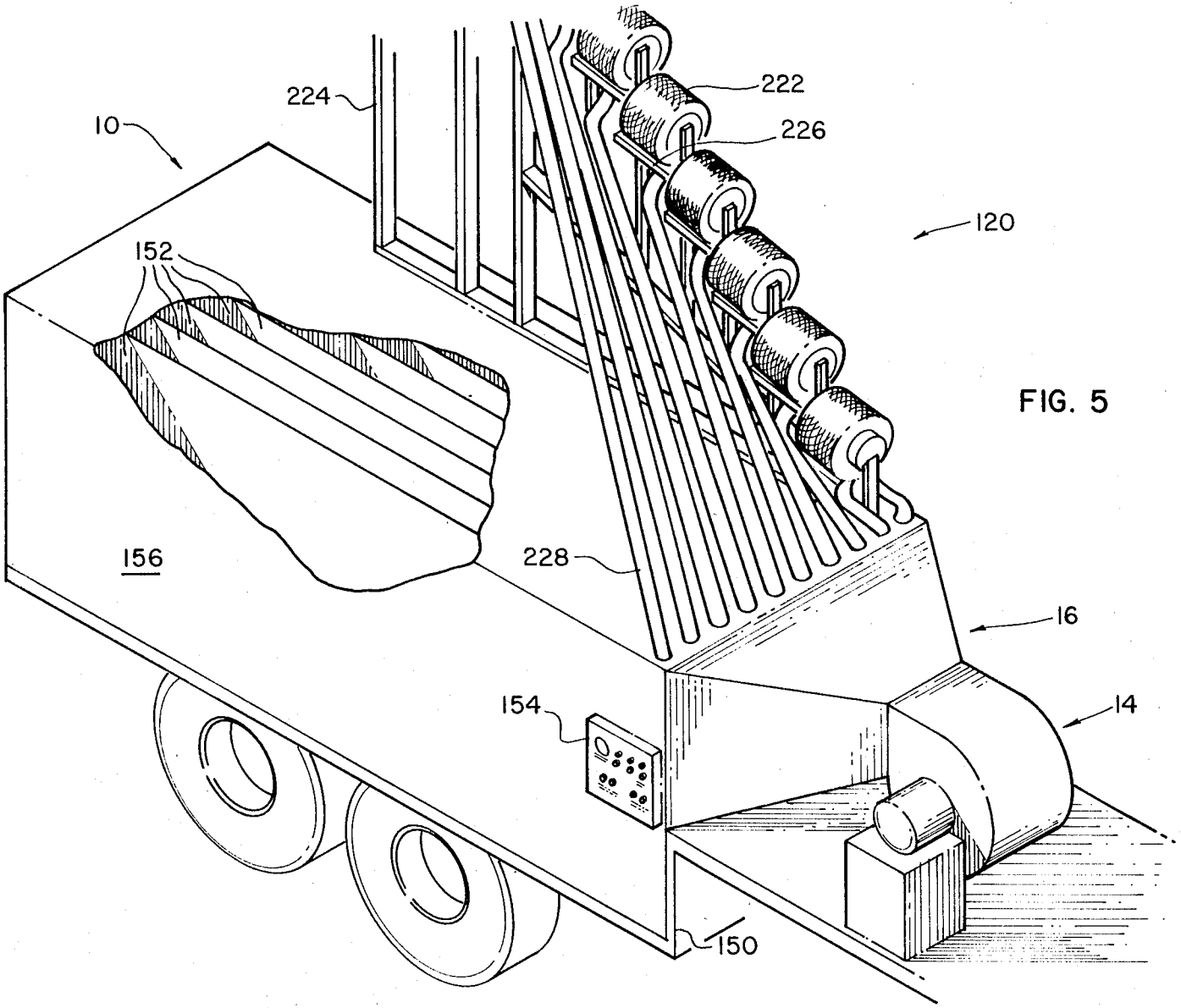
FIG. 5 is a perspective view of a truck bed mounted dry material sorting device with multiple wind tunnel chambers and attached screen apparatus.

In one method of practicing the invention granular material 15 is screened before it is injected into the injection chamber 66. One screening arrangement as shown by FIG. 4 comprises a series of screen means such as a wire screen mesh 130 mounted on a rectangular wood frame 128 in turn pivotally mounted in vertical alignment between two vertical post members 124 mounted on a rectangular base 126. Each screen 131–139 is of progressively smaller mesh from top to bottom. Granular material poured onto the top screen will therefore descend through the screens with each screen retaining those particles having a diameter larger than the retaining screen and smaller than the screen mounted immediately above it. For example, in order to retain particles on each screen where the ratio of the minimum particle diameter to the maximum particle diameter is not greater than 2:1 the following screen sizes may be used: first screen 131 may be provided with #2 mesh having a clear opening of 0.380 inches; second screen 132 with #4 mesh, opening 0.178 inches; third screen 133 with #8 mesh, opening 0.090 inches; fourth screen 134 with #16 mesh, opening 0.0445 inches; fifth screen 135 with #30 mesh, opening 0.0223 inches; sixth screen 136 with #50 mesh, opening 0.011 inches; seventh screen 137 with #100 mesh, opening 0.0055 inches; eighth screen 138 with #200 mesh, opening 0.0029 inches; ninth screen 139 with #400 mesh, opening 0.0015 inches. The screens may be alternately tilted in opposite directions and provided with collection troughs (not shown) to collect the materials retained on each tray. A batch of material retained on any given screen 131–139 is placed in the hopper 18, one batch at a time, for sorting. Other screening means and conveying means for placing individual batches in a wind tunnel 12 may also be practiced. For example, a cascading series of mesh covered drums 222 mounted on a suitable frame 224 may be provided with inclined collection trays 226 mounted immediately below each drum 222 and discharging into the interior of each succeeding drum 12. End chutes 228 may be provided to collect material retained on the interior of each drum and rolling out the lower end thereof through the action of gravity. As shown in this embodiment the chutes 228 may be adapted to feed into a multiple air chamber arrangement 152 to facilitate continuous blowing of materials rather than blowing of individual batches in a single chamber 33. In such an arrangement a single blower 14 with multiple ported air ducts 16 may be equipped with control valves (not shown) and a control panel 154 to match the air flow velocity with the particular particle size in a given air chamber 152. Multiple blowers (not shown) could also be used. Such a unit might be mounted on a truck bed 150 to facilitate transportation from site to site.

In practice a screened batch of granular material 15 containing substances of two different specific gravities, such as gold and sand, is loaded into hopper unit 18 with the slit closure plate 84 in the up position. The slit width is adjusted to the proper dimension for the material. The fan 42 is then turned on and adjusted to a velocity compatible with the material 15 in the hopper 18. In one embodiment the height of the flow chamber 33 is less than 6 feet, the flow velocity through the chamber is less than 100 feet per second and the maximum to minimum diameter ratio of the particles on any screen is less than 2.1:1. Suitable adjustments are made through the use of vein control knobs 58, 62 to provide a uniform air flow through the wind tunnel 12. The slit closure plat 84 is then lowered allowing a narrow band of particles 15 to fall into the injection chamber 66. As the granular material particles 15 fall into the injection chamber 66 horizontal air flow through the chamber accelerates the particles in a downstream direction. As described above, if the particles are properly screened material having a higher specific gravity will tend to fall out of the air chamber near the injection point with lower specific gravity particles falling out farther downstream. Particles fall through the skirt 36 and are directed towards the center of collection tray 20. Where more than two types of material are present in the mixture those of intermediate specific gravity will tend to fall out in an intermediate area although there may be some overlapping in bands of material where the specific gravity of any two materials are relatively close.

Figure 6:
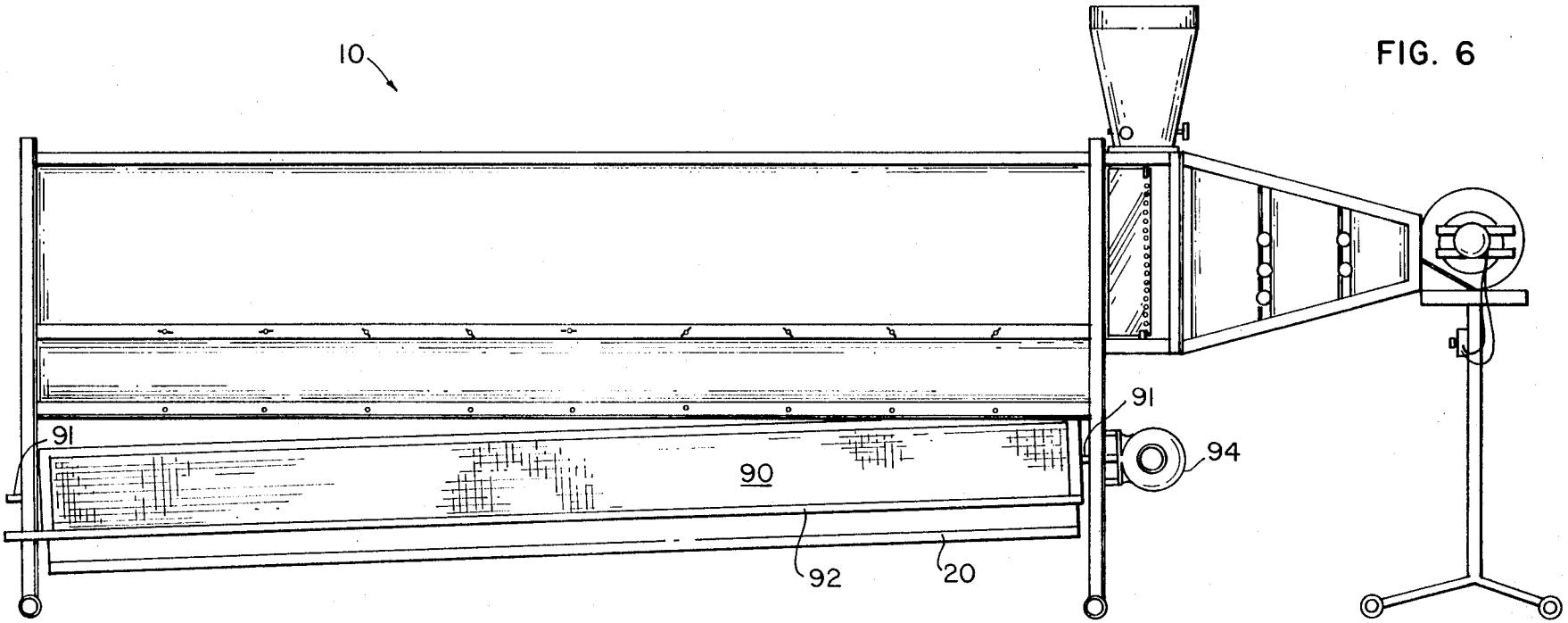
FIG. 6 is an elevation view of another embodiment of a dry material sorting device.
Figure 8:
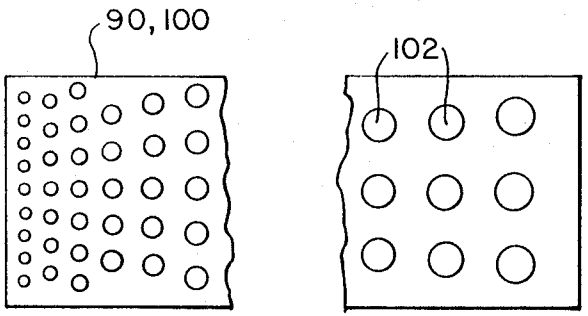
FIG. 8 is a plan view of another embodiment of a dynamic screen.
Figure 7:
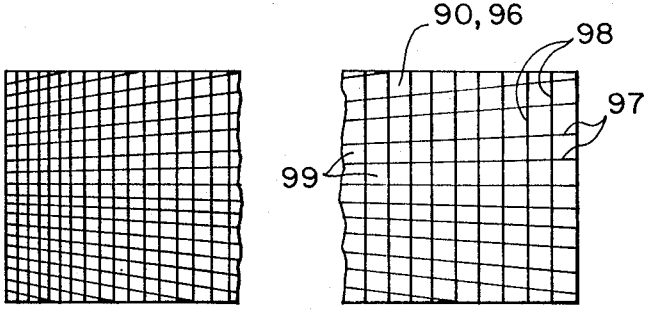
FIG. 7 is a plan view of a dynamic screen.

As illustrated by FIG. 6 a dynamic screen 90 may be used to obviate prescreening. As illustrated schematically by FIG. 7 the dynamic screen may comprise a wire mesh having progressively smaller apertures therein or as shown by FIG. 8 may comprise a plate bored with holes of progressively smaller size proceeding in a downstream direction. In practice the dynamic screen will have to be constructed on the basis of the "fallout" characteristics of the particle having the higher specific gravity and will also depend on the air velocity in the wind tunnel 12. In this embodiment of the invention the collection tray 20 is mounted below the dynamic screen 90 and a side trough 92 is mounted at the edge of the dynamic screen. As described above as particles fall through the wind tunnel those having a higher specific gravity tend to fall out nearer the drop point than those with a lower specific gravity of the same diameter. By properly sizing the dynamic screen heavier particles may be caused to fall through the screen into the collection plate 20 while the lighter materials are retained on the screen surface. The tray 90 may be tilted in the direction of the trough 92 and may also be vibrated as by a vibrator 94 to cause the retained material to roll off the screen into the trough 92. Thus where gold laden sand is being processed gold will be collected in the tray 20 while sand with a lower specific gravity will be retained on the screen and drift into the side trough 92.

While the inventive concepts that are disclosed herein have been described in reference to illustrative and presently preferred embodiments, it is contemplated that the inventive concepts may be variously otherwise embodied and practiced than as herein specifically described. It is intended that the appended claims be construed to include alternative forms of the invention except insofar as precluded by the prior art.

What is claimed is:

1. A dry material sorting device for sorting dry homogeneous mixtures of chemically distinct materials into constituent materials wherein the materials to be sorted comprise granular particles of various sizes and comprise a first material such as gold or the like having a relatively high specific gravity and a second material such as sand or the like having a relatively low specific gravity, said sorting device comprising:

(a) horizontally disposed wind tunnel means defining an elongate unrestricted flow chamber for directing a horizontal airflow said windtunnel means comprising a top, a bottom, an upstream end and a downstream end;

(b) air forcing means operably mounted on said wind tunnel means for inducing a horizontal airflow through said wind tunnel means maintained at substantially constant velocity by said wind tunnel means;

(c) granular material sizing means for segregating granular material on the basis of particle diameter;

(d) granular material injection means positioned at the top upstream end of said wind tunnel means for fallingly injected sizingly segregated granular particles into an uppermost portion of said horizontal airflow in said wind tunnel means whereby said granular particles are differentially accelerated by said horizontal airflow during vertical free fall of said particles from the top to the bottom of said wind tunnel means;

(e) granular material exit means operably positioned at the bottom of said wind tunnel for fallingly discharging said granular material from said wind tunnel means;

(f) granular material collection means, external of said wind tunnel means, for collecting granular material falling from said exit means;

wherein said granular material sizing means comprises a plurality of screen means of progressively smaller mesh operably arranged in elevationally descending relationship whereby the retained particles on each said screen means have a preselected diameter range comprising a minimum diameter and a maximum diameter, wherein the ratio of maximum diameter to minimim diameter of the particles retained on said screen means is a preselected ratio dependent on the ratio of specific gravities of said first material and said second material and wherein the velocity of said horizontal airflow is a preselected value dependent upon the size of particles to be sorted;

wherein said air forcing means comprises blower means for blowing air operably mounted proximate said upstream end of said wind tunnel means in fluid communication therewith and discharging therein;

wherein said wind tunnel means comprises a flow chamber having a uniform generally rectangular cross section of constant predetermined height defined by two spaced apart vertical walls having an upper edge and a lower edge and a horizontal top wall sealingly connected to said vertical walls proximate the upper edges thereof, said vertical walls being unconnected at the bottom edge thereof and defining a lower opening of said flow chamber;

wherein said granular material exit means comprises said lower opening of said flow chamber and further comprises a longitudinally extending skirt means having a generally V-shaped cross section with an opening, the lower end thereof operably attached to the lower edges of said vertical wall for funnellingly inwardly directing granular material falling from said flow chamber, said skirt means being transversely unrestricted between opposite upstream and downstream ends thereof.

2. The dry material sorting device of claim 1 wherein said longitudinally extending skirt means comprises means for impairing horizontal airflow therethrough.

3. The dry material sorting device of claim 2 wherein the ratio of maximum diameter to minimum diameter of substantially all particles retained on said screen means comprises a range of 1:1 to 2:1.

4. The dry material sorting device of claim 1 wherein said blower means comprises volume control means for controlling the volume of air discharged into said wind tunnel means and airflow adjustment means for cooperating with said wind tunnel means to provide a uniformly airflow distribution of constant velocity throughout said wind tunnel means.

5. The dry material sorting device of claim 4 wherein said airflow adjustment means comprises:

pressure equalization means for equalizing the air pressure throughout a tunnel cross section at said wind tunnel upstream end, and vane means for directing said wind tunnel airflow.

6. The dry material sorting means of claim 1 wherein said granular material collection means comprises elongated tray means mounted below said granular material exit means.

7. The dry material sorting means of claim 1 wherein said granular material injection means comprises hopper means mounted on the upper portion of said wind tunnel means proximate the upstream end thereof for holding and selectively injecting said sizingly segregated granular particles into said wind tunnel means.

8. The dry material sorting means of claim 7 wherein said hopper means comprises a transverse slit opening means at the lower end thereof for injecting said particles in a narrow transverse band.

9. The dry material sorting means of claim 8 wherein said hopper means comprises slit narrowness adjustment means for adjusting the narrowness of said slit opening means to accomodate particles retained by different screen means.

10. The dry material sorting means of claim 7 wherein said wind tunnel means comprises a plurality of flow chambers.

11. The dry material sorting means of claim 10 further comprising flow chamber velocity control means for controlling the velocity of air passing through each said chamber whereby different chambers may have selectively different air velocities.

12. The dry material sorting means of claim 10 wherein said granular material injection means comprises a plurality of chute means operably associated with said flow chamber means for transferring granular material from said screen means to said hopper means wherein each screen means is operably associated with a separate hopper means.

13. The dry material sorting device of claim 1 wherein each said screen means comprises a flat screen mounted on a screen frame in vertical alignment with said other screen means.

14. The dry material sorting device of claim 1 wherein each said screen means comprises a rotating, mesh surfaced, hollow cylinder positioned in inclined cascading relationship with said other screen means.

15. The dry material sorting device of claim 1 wherein said predetermined height of said flow chamber is less than 6 feet and wherein the air flow velocity through said air chamber is less than 100 feet per second and wherein the maximum to minimum diameter ratio of particles retained on any said screen means is less than 2.1:1.

16. A granular material sorting device for sorting dry granular material mixtures including sand and gold of mixed particle sizes comprising:

granular material sizing means for segregating the granular material into batches wherein substantially all particles within a given batch have diameters less than twice the diameter of the smallest diameter particles in the batch;

horizontally disposed transversely unrestricted wind tunnel means of substantially constant and uniform cross-section throughout the length thereof for directing a horizontal airflow therethrough of relatively constant velocity from top to bottom and upstream end to downstream end of said wind tunnel means, said horizontally disposed wind tunnel having an open bottom portion;

air forcing means for inducing said relatively constantly velocity horizontal airflow through said wind tunnel means;

granular material injection means for free fallingly injecting said sizingly sorted granular material mixture into said wind tunnel means proximate the upstream end thereof and proximate the top thereof in a stream extending across said wind tunnel means and having a stream dimension measured longitudinally of said horizontal airflow sufficiently small to prevent piggybacking of particles exposed to said horizontal airflow whereby substantially all said particles are directly acted on by said airflow during the period of vertical free fall of said granular particles from the top to the bottom opening of said wind tunnel means;

exit means operably mounted at the bottom of said tunnel means in fluid communication therewith, said exit means comprises a relatively narrow longitudinally extending opening therein for discharge of particles therefrom, said exit means comprising relative low velocity airflow interface means between said wind tunnel horizontal airflow and the atmosphere;

collection means positioned below said exit means for collecting granular material falling from said exit means;

whereby said granular material is sorted into its different component materials, the gold particles falling into said collection means at a relatively downstream portion thereof, the sand particles falling into said collection means at a relatively upstream portion thereof.

17. A granular material sorting device for sorting dry material mixtures including relatively low density particles and relatively high density particles, such as sand and gold of mixed particle sizes comprising:

granular material sizing means for segregating the granular material into batches wherein the maximum to minimum diameter of particles in any batch is a preselected ratio dependent on the ratio of specific gravities of the different materials to be sorted;

horizontally disposed transversely unrestricted wind tunnel means of substantially constant and uniform cross section throughout the length thereof for directing a horizontal airflow therethrough of relatively constant velocity from top to bottom and upstream end to downstream end of said wind tunnel means, said horizontally disposed wind tunnel having an open bottom portion;

air forcing means for inducing said relatively constant velocity horizontal airflow through said wind tunnel means;

granular material injection means for free fallingly injecting said sizingly sorted granular material mixture into said wind tunnel means proximate the upstream end thereof and proximate the top thereof in a stream extending across said wind tunnel means and having a stream dimension measured longitudinally of said horizontal airflow sufficiently small to prevent piggybacking of particles exposed to said horizontal airflow whereby substantially all said particles are directly acted on by said airflow during the period of vertical free fall of said granular particles from the top to the bottom opening of said wind tunnel means;

exit means operably mounted at the bottom of said tunnel means in fluid communication therewith, said exit means comprising a relatively narrow longitudinally extending opening therein for discharge of particles therefrom, said exit means comprising relatively low velocity airflow interface means between said wind tunnel horizontal airflow and the atmosphere;

collection means positioned below said exit means for collecting granular material falling from said exit means;

whereby said granular material is sorted into its different component materials, the higher density particles such as gold particles falling into said collection means at a relatively upstream portion thereof, the lower density particles such as sand particles falling into said collection means at a relatively downstream portion thereof.

* * * * *